US006082686A

United States Patent [19]

Schumann

[11] Patent Number: 6,082,686

[45] Date of Patent: Jul. 4, 2000

[54] HOLDING DEVICE

[75] Inventor: Jörn Schumann, Reinbek, Germany

[73] Assignee: Beiersdorf AG, Hamburg, Germany

[21] Appl. No.: 09/132,394

[22] Filed: Aug. 11, 1998

[30] Foreign Application Priority Data

Aug. 14, 1997 [DE] Germany ..... 197 35 229

[51] Int. Cl.[7] ..... A47G 1/14; F16B 45/00

[52] U.S. Cl. ..... 248/205.3; 205/308

[58] Field of Search ..... 248/205.3, 205.4, 248/222.51, 304, 308

[56] References Cited

U.S. PATENT DOCUMENTS

| | | | |
|---|---|---|---|
| 3,561,077 | 2/1971 | Grant | 248/205.3 |
| 3,637,181 | 1/1972 | Janssen | 248/205 A |
| 4,310,137 | 1/1982 | Frye | 248/467 |
| 4,986,504 | 1/1991 | Gary | 248/205.3 |
| 5,507,464 | 4/1996 | Hamerski et al. | 248/683 |
| 5,695,161 | 12/1997 | Brozak, Jr. | 248/215 |
| 5,890,688 | 4/1999 | Rioedan | 248/205.3 |

FOREIGN PATENT DOCUMENTS

| | | | |
|---|---|---|---|
| 2702824 | 1/1977 | Germany | 248/205.3 |
| 493686 | 3/1938 | United Kingdom | 248/220.21 |

*Primary Examiner*—Ramon O. Ramirez
*Assistant Examiner*—Jerome A. DeLuca
*Attorney, Agent, or Firm*—Norris, McLaughlin & Marcus, P.A.

[57] ABSTRACT

Holding device,comprising a hook body, hinge element and baseplate with an adhesive strip which releaess on pulling and having a grip tab that protrudes beyond the baseplate, wherein the grip tab is normally covered but the hook body can be raised upwards out of its basic position, so that access to the grip tab is possible.

6 Claims, 8 Drawing Sheets

HOLDING DEVICE

The invention relates to a holding device which, by means of adhesive strips which release on pulling, is reversibly bondable and reusable, possibly with a new such adhesive strip.

Adhesive strips which release on pulling are commercialized as "tesa Power-Strips" by Beiersdorf AG and are also described by numerous patents, such as DE 33 31 016 B1, DE 42 22 849 B1, DE 43 39 604 B1, DE 44 28 587 B1 and DE 44 31 914 B1. In addition, U.S. Pat. No. 4,024,312, WO92/11332, WO92/11333 and WO95/06691 describe adhesive strips of this kind. Such adhesive strips are pulled out of the bond in the direction of the bond joint, in a way comparable with the opening of a preserving jar.

For instance, U.S. Pat. No. 4,024,312 describes a pressuresensitive adhesive tape having extensible and elastic backing composed of a block copolymer, in particular for applications in the medical area, where painless pulling off of the skin is desirable.

Furthermore, DE 33 31 016 A1 describes an adhesive film for re-releasable adhesive bonds which allows an adhesive bond established therewith to be released by pulling on the adhesive film in the direction of the bonding plane. With such adhesive films, high adhesive forces and shear strengths can be achieved and adhesive bonds can be released again without further aids, in a way comparable to the opening of a preserving jar, similar to the way in which there the rubber seal is pulled by the grip out of the seal joint.

Furthermore, DE 37 14 453 C1 describes a practice explosive charge which can be detached again from practice objects without destroying it and is reversibly fastened by such an adhesive film.

WO 92/11333 also describes, inter alia, adhesive films for corresponding applications, the adhesive films used having a low elasticity with at the same time high extension.

DE 42 22 849 C1 likewise describes a strip of an adhesive film of this kind with a specially shaped grip tab.

In addition, hooks or similar fastening systems for use together with such adhesive strips are commercially available as "tesa Power-Strips mit Haken" or [with hooks] else "tesa Power-Strips Systemhaken" [system hooks ] from Beiersdorf AG.

Finally, DE 42 33 872 C2, DE 195 11 288 B1 and WO 94/21157 describe re-releasable self-adhesive hooks which are likewise provided with such adhesive films and are also re-releasable.

However, the adhesive systems and hooks represented in the above-mentioned publications also have a number of disadvantages:

Problems with hooks and the like of the prior art are, on the one hand, the visual concealment of the grip tab, which for the subsequent pulling must protrude beyond the device, and, on the other hand, the protection of this grip tab against manipulation or damage, including in particular damage by UV light.

Also, a multi-part design, as disclosed by the prior art, is disadvantageous whenever one part is lost or falls down, for instance during assembly. This risk increases the smaller the hooks are in their dimensions.

The object of the invention was to remedy this situation and, in particular, to provide a hook or the like which does not have the disadvantages of the prior art, or at least not to the same extent.

SUMMARY OF THE INVENTION

The invention relates accordingly to a holding device, especially a hook, comprising a one-part hook body, at least one one-part hinge element and a one-part baseplate, the baseplate for the bond with an adhesive strip which releases on pulling being designed such that a grip tab of the adhesive strip protrudes beyond the baseplate, the hinge element being designed such that the grip tab located on the adhesive strip is covered and the hook body being designed such that it covers over the baseplate and the hinge element, which are both arranged in one plane, in which device a) the baseplate and the hinge element are connected to each other by means of a hinge, b) the hinge element and the hook body are connected to each other by means of a hinge, and in which device, on the side adjacent to the hinge element, the hook body can be raised upwards out of the basic position, in which the hook body is anchored on the baseplate and thereby covers over the baseplate and the hinge element of the adhesive strip, and is displaced by a movement parallel to the baseglate, so that access to the grip tab is possible.

DETAILED DESCRIPTION

The holding device according to the invention comprises a one-part hook body, at least one one-part hinge element and a one-part baseplate, which are undetachably bonded to one another, the baseplate for the bond with an adhesive strip which releases on pulling being designed such that a grip tab of the adhesive strip protrudes beyond the baseplate, the hinge element being designed such that the grip tab located on the adhesive strip is covered and the hook element being designed such that it covers over the baseplate and the hinge element, which are both arranged in one plane.

The baseplate and the hinge element are connected to each other by means of a hinge. The hinge element and the hook body are likewise connected to each other by means of a hinge.

On the side adjacent to the hinge element, the hook body can be raised upwards out of the basic position, in which the hook body is anchored on the baseplate and thereby covers over the baseplate and the hinge element of the adhesive strip, and is displaced by a movement parallel to the baseplate, so that access to the grip tab is possible.

In a preferred embodiment, the hinges are film hinges.

In a further preferred embodiment, on the upper edge of the baseplate and on the hook body there is articulated an upper hinge element and on the lower edge of the baseplate and on the hook body there is articulated a lower hinge element, the said hinge elements preferably having the same dimensions.

The hook body and/or the baseplate are preferably produced from metal or plastic, most preferably polyethyleneterephthlate, polystyrene or ABS.

The hook body advantageously has a border which laterally encloses and visually conceals the baseplate and the adhesive strip to be adhesively attached behind the latter.

Finally, the holding device has an adhesive strip adhesively attached behind the baseplate.

With the aid of the holding device according to the invention, the disadvantages known from the prior art are avoided in an outstanding way.

No part of the holding device can be lost. The hook body may also be used for grasping during the stripping operation.

Furthermore, a material mix is possible in the case of the hook body and baseplate, i.e. an optimum selection of the materials according to the application is possible.

The basic principle of the releasing operation of this holding device is that the hook body which is seated on the baseplate, and thereby covers the latter completely, is displaced in order in this way to give free access to the adhesive strip.

Particularly advantageous embodiments of the holding device according to the invention are presented in more detail below with reference to several figures, without wishing to restrict the invention unnecessarily by doing so.

BRIEF DESCRIPTION OF THE DRAWINGS

In FIG. 1, the hook body 1 of the holding device is represented in a lateral section. The hook wall 11 of the hook body 1 comprises a preferably rectangularly shaped plate 111, which is completely surrounded by an overhanging border 112. On the portion of the border 112 at the top an edge 113 is formed, so that between plate 111 and edge 113 there is created an intermediate space, into which a projection 25 of the baseplate 2 engages. The edge 113 thereby undercuts the baseplate 2. On the portion of the border 112 at the bottom there are a total of two eyelets 114, which protrude into the interior of the border 112 and serve for receiving two pins 34 of the hinge element 3 (FIG. 2).

On the hook wall 11, to be precise opposite the border 112, there is integrally formed a hook 12, which serves for receiving any desired items, for example items of clothing, towels, etc.

Figure 2:
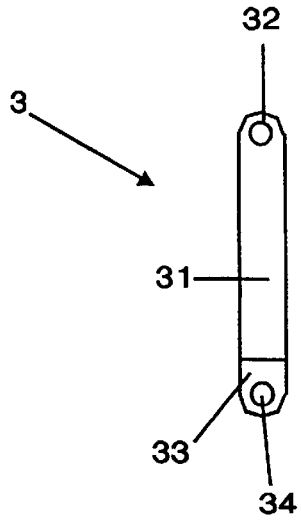
FIG. 2 shows the hinge element if the holding device, which is associated with the hook body of FIG. 1, in lateral view.
Figure 3:
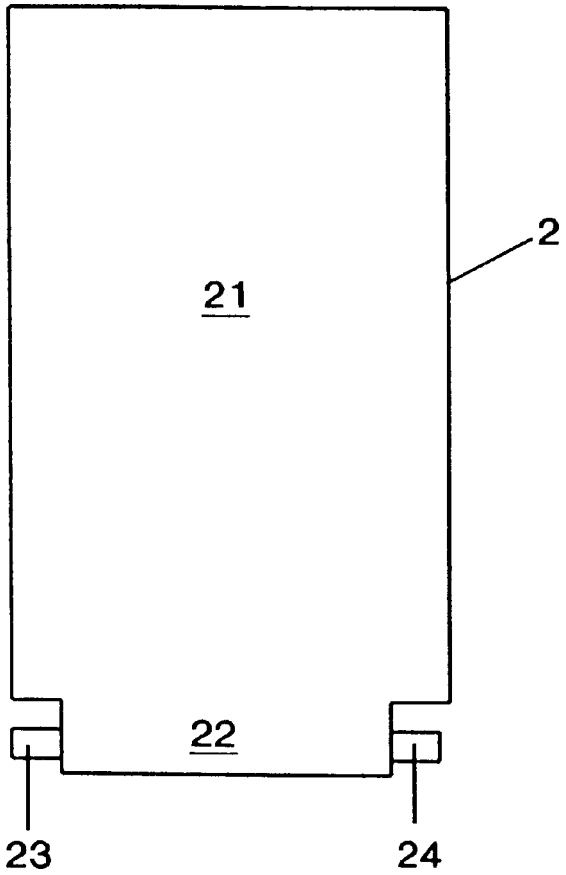
FIG. 3 shows the baseplate of the holding device in plan view.

FIG. 2 shows the hinge element 3. The hinge element 3 has a substantially rectangularly shaped body 31. On the upper side face of the body 31 there are two eyelets 32, respectively lying on the outside and serving for receiving the pins 23, 24 of the baseplate 2 (FIG. 3). Formed in the lower region of the body 31 there are two bulges 33. In the bulges 33 there are provided two pins 34, which are aligned parallel to the lower side face of the body 31 and which engage in the eyelets 114 of the hook body 1.

Figure 4:
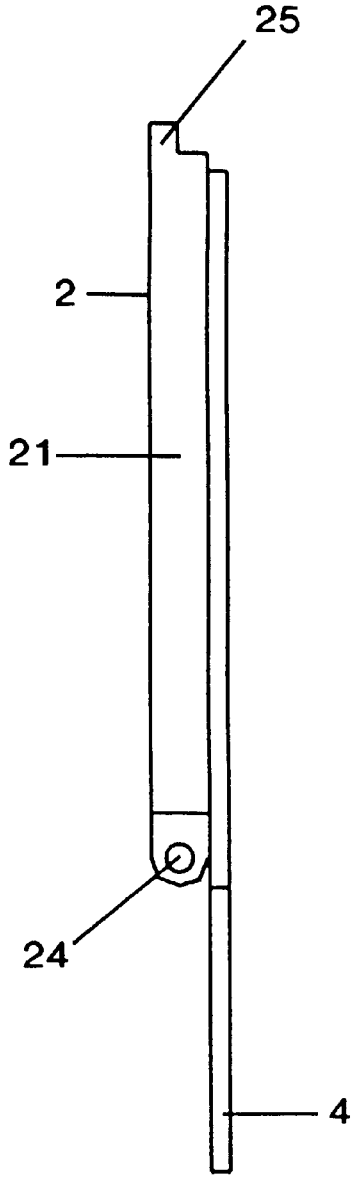
FIG. 4 shows the basseplate bonded to an adhesive strip.

FIG. 3 shows the baseplate 2 and FIG. 4 shows the baseplate 2 bonded by means of an adhesive strip 4 in lateral view, the protruding region of the adhesive strip 4 not being provided with adhesive, in other words forming a grip tab for the adhesive strip 4. The baseplate 2 comprises a substantially rectangularly shaped base 21. In the lower region of the base 21 there is an extension 22, which bears two pins 23, 24 on its side faces. The pins 23, 24 are aligned parallel to the lower edge of the base 21, do not protrude beyond the sides of the base 21 and engage in the eyelets 32 of the hinge element 3. At the upper region of the base 21 there is a projection 25 (FIG. 4, which engages into the intermediate space between plate 111 and edge 113.

Figure 5C:
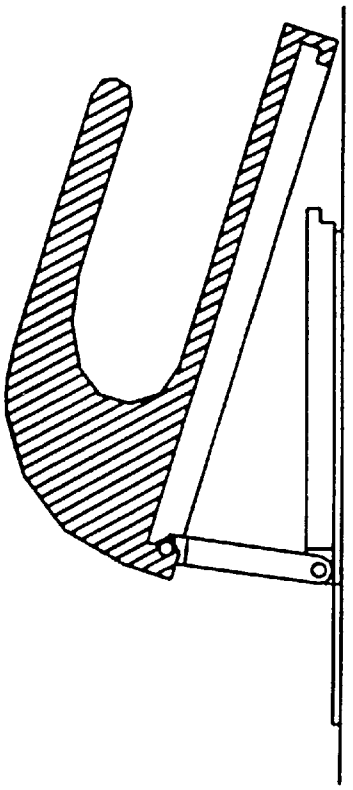
FIG. 5*a* to 5*c* show the operation of releasing the holding device with the baseplate from FIG. 4, which has been adhesively attached on an underlying surface by means of an adhesive strip.
Figure 5B:
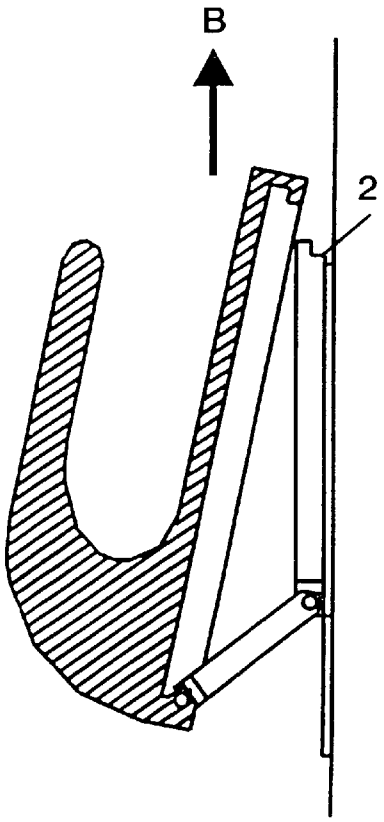
Figure 5A:
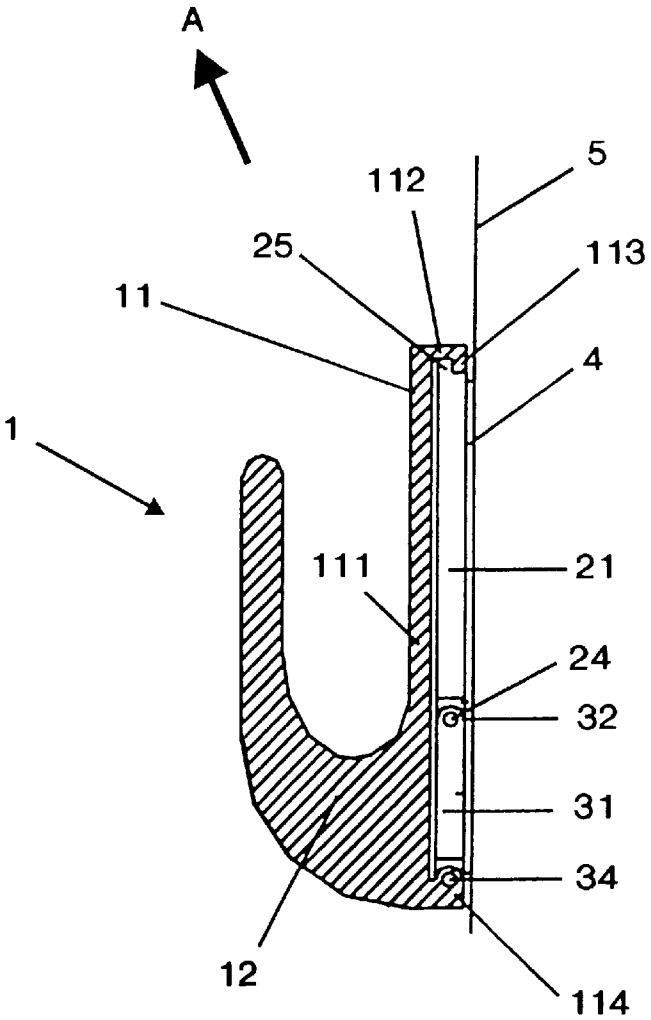

FIGS. 5*a* to 5*c* show the releasing operation of the holding device, comprising hook body 1 and baseplate 2, which are adhesively attached on an underlying surface 5, for example a tile, by means of the adhesive strip 4. In FIG. 5*a*, the holding device is in the closed state. For this purpose, the baseplate 2 is fixed by the adhesive strip 4 to substrate 5 (i.e., a wall). The adhesive strip 4, together with grip tab, the baseplate 2 and the hinge element 3 are completely covered by the hook body 1. Attached on the baseplate 2 is the hinge element 3. The hinge element 3 is linked to the hook body 1. The hook body 1 is attached on the baseplate 2 by means of the edge 113, so that the hook 12 can be subjected to loading.

For releasing the holding device from the wall, the hook body 1 is lifted off the underlying surface 5, as specified by the arrow A. Subsequently, the hook body 1 is moved upwards according to arrow B, in other words parallel to the bonding plane, until the hook body 1 can be removed from the baseplate 2.

By virtue of the design with the hinge element 3, the holding device has great flexibility, without the hook body, the baseplate 2 or the hinge element 3 having to be separated from one another. The hook body 1 is advantageously moved upwards until the hinge element 3 is aligned almost vertically with respect to the underlying surface 5. Then, the grip tab of the adhesive strip 4 is freely accessible and can be released from the underlying surface 5 by pulling in the direction of the bonding plane, because the pulling forces lead to a reduction in the adhesive forces. At the same time, however, the adhesive strip 4 is also released from the baseplate 2, so that the holding device is likewise removed from the underlying surface and can be adhesively attached again.

Figure 1:
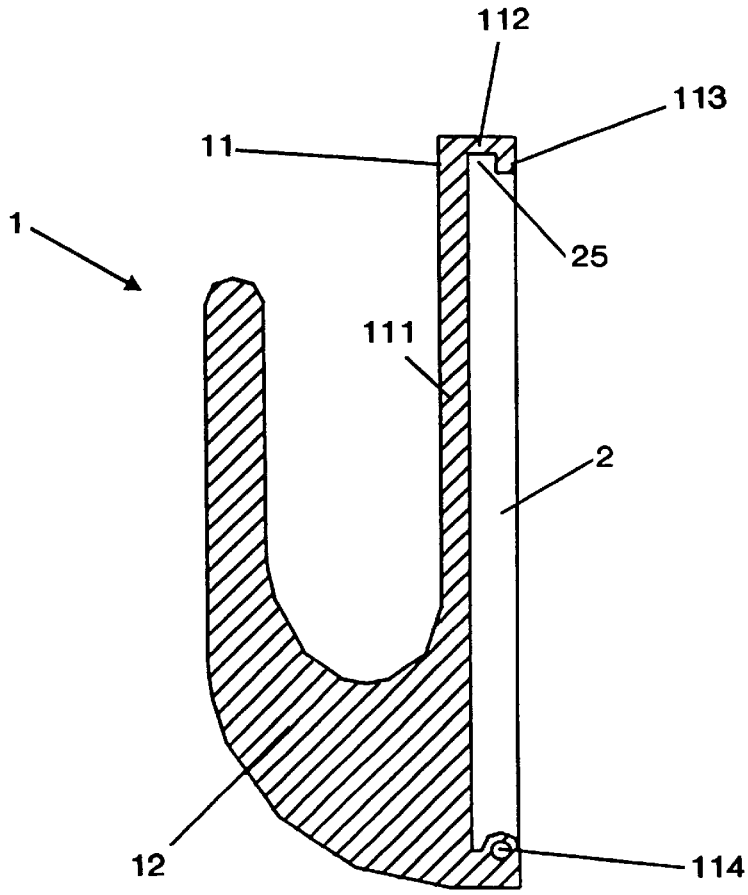
FIG. 1 shows one embodiment of the hook body of the holding device in lateral view.
Figure 6:
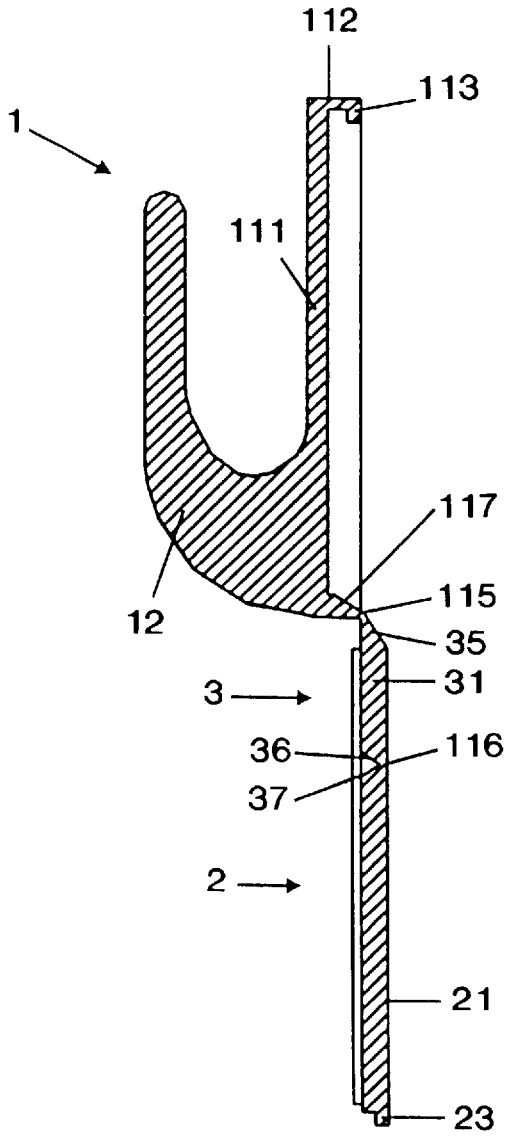
FIG. 6 shows another preferred embodiment of the hook body with the baseplate of the holding device in plan view.
Figure 7:
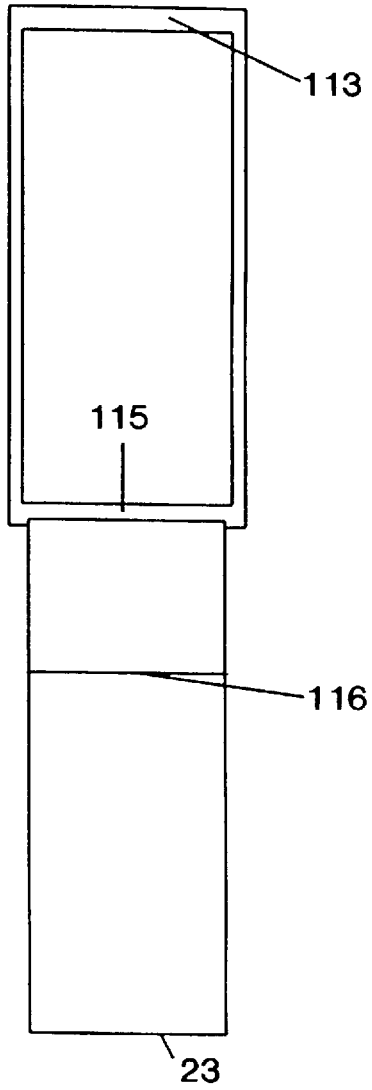
FIG. 7 shows the baseplate of the holding device bonded to an adhesive strip in lateral view

Another preferred embodiment of the hook body 1 is represented in FIG. 6. The holding device shown here differs from that from FIGS. 1 and 2 in that the connection between hook body 1 and hinge element 3 or between baseplate 2 and hinge element 3 does not take place by means of eyelets and pins but by means of film hinges 115, 116. For this purpose, on the hook body 1 the lower portion of the border 112, the hinge edge 117, is bevelled at an angle of 45°.

The hinge element 3 is articulated by means of the film hinge 115. The hinge element 3 comprises a substantially rectangularly shaped body 31, the upper edge 35 of which is bevelled at an angle of 45° in such a way that the hinge edge 117 and the edge 35 can lie one on top of the other. The lower edge 36 is likewise bevelled at an angle of 45°.

The film hinge 116 is used for articulating the baseplate 2, by means of the edge 37. The edge 37 is likewise bevelled at an angle of 45°, there being a V-shaped cutout of 90° between the edge 37 and the edge 36 when the baseplate 2 and the hinge element 3 are in parallel alignment, in order to ensure the necessary mobility of the film hinge 116.

Figure 8C:
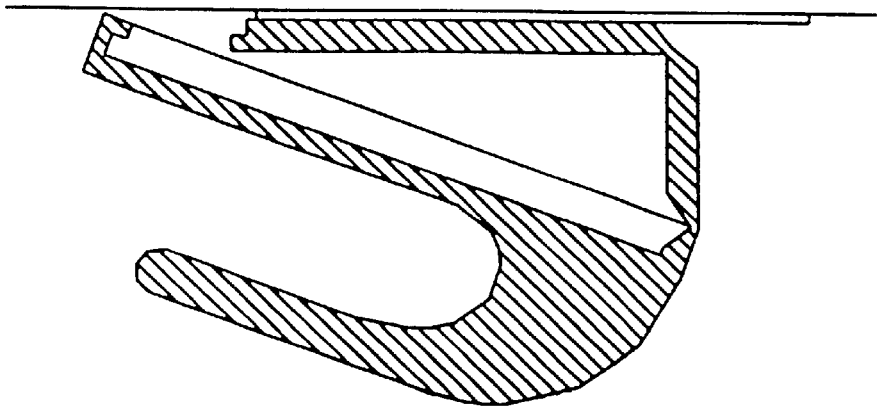
FIGS. 8*a* to 8*c* show the operation of releasing the holding device with the baseplate from FIG. 6, which has been adhesively attached on an underlying surface by means of an adhesive strip.
Figure 8B:
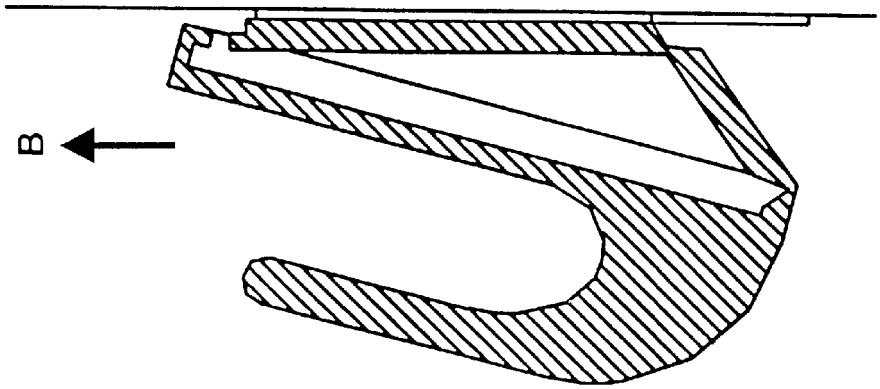
Figure 8A:
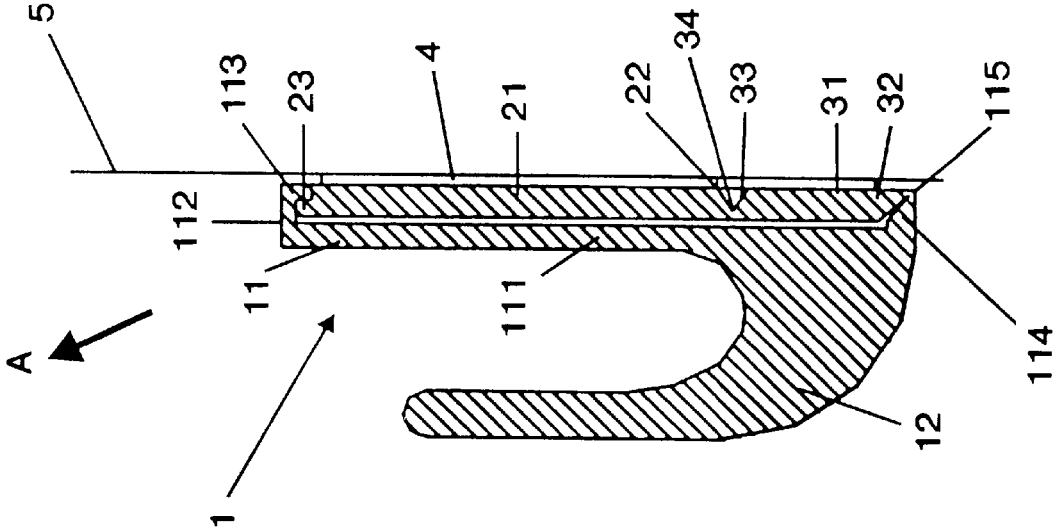

FIGS. 8*a* to 8*c* illustrate the releasing operation of the holding device shown in FIG. 4. The procedure for this corresponds exactly to the operation presented in FIGS. 5*a* to 5*c*.

Figure 9:
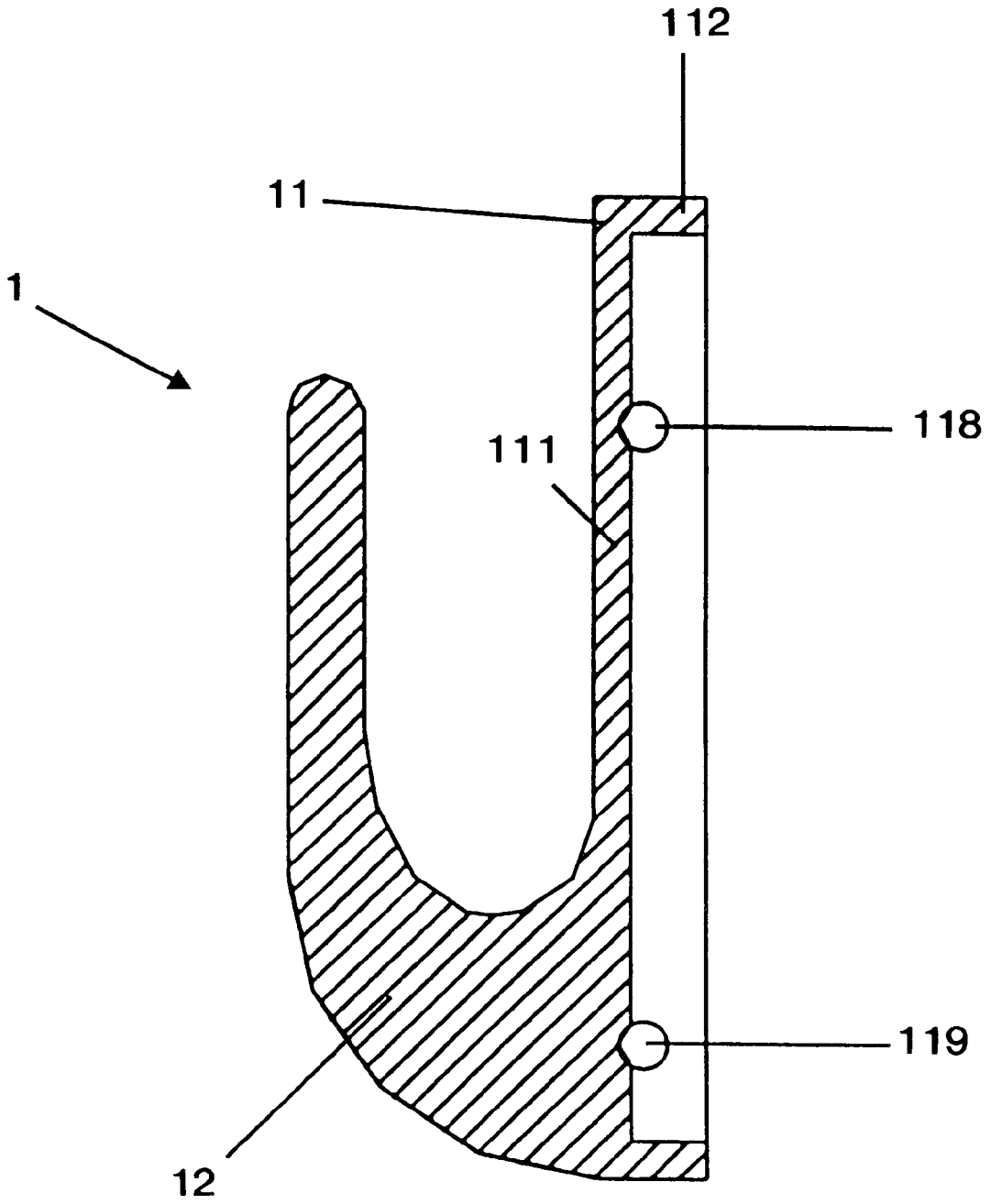
FIG. 9 shows a further preferred embodiment of the hook body of the holding device in lateral view.

A further preferred embodiment of the hook body 1 of the holding device is represented in FIG. 9 in lateral section.

The hook wall 11 of the hook body 1 comprises a preferably rectangularly shaped plate 111, which is completely surrounded by an overhanging border 112. Directly underneath the plate 111 there are in the border 112 a total of four blind holes 118, 119, which are respectively arranged in pairs opposite one another. The blind holes 118, 119 serve for receiving the pins 34, which are on the hinge elements 3.

Figure 10:
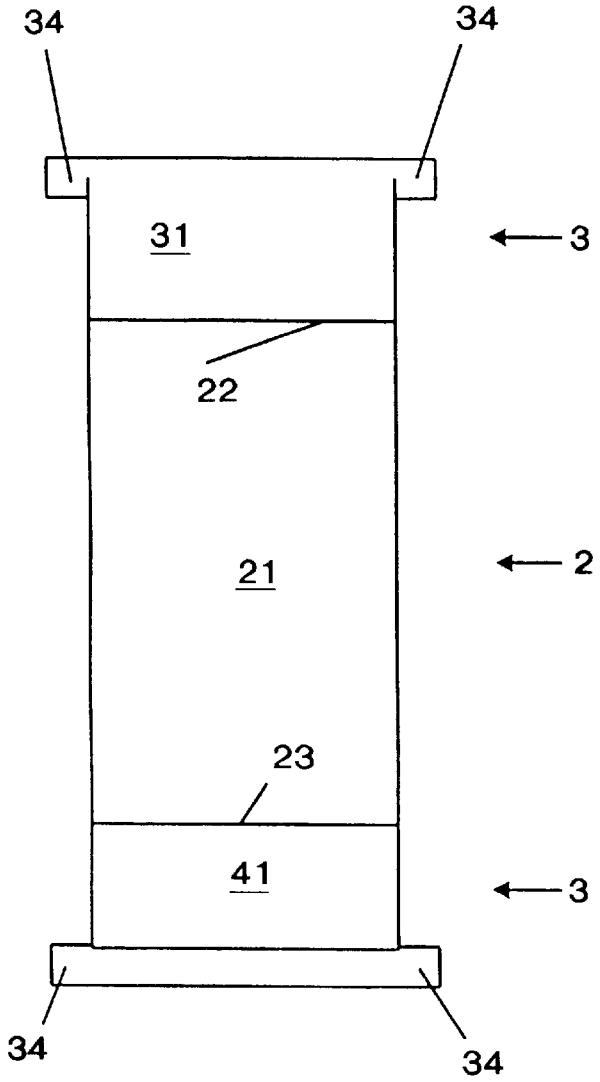
FIG. 10 shows the baseplate of the holding device in plan view.
Figure 11:
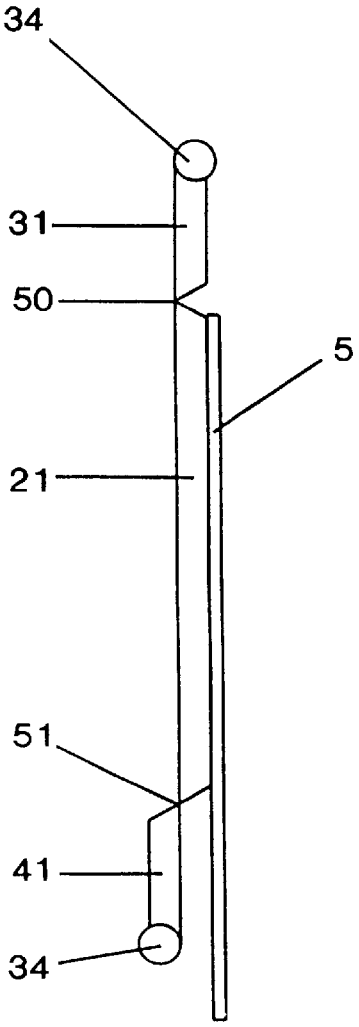
FIG. 11 shows the baseplate bonded to an adhesive strip, two hinqe elements being articulated on the baseplate.

FIG. 10 shows the baseplate 2, which together with the hook body 1 according to FIG. 9 forms a holding device. The baseplate 2 comprises a rectangularly shaped base 21. At the upper edge, a first hinge element 3 is articulated by means of a film hinge 50, so that the baseplate 2 and the hinge element 3 lie in one plane. In order to ensure adequate mobility of the film hinge, the neighbouring edges on hinge element 3 and baseplate 2 are bevelled at an angle of 45°. On the upper edge of the film hinge 3 there are laterally protruding pins 34, which engage into the blind holes 118 of the hook body 1. A second hinge element 3 is articulated on the lower edge of the baseplate 2 by means of a film hinge 51, so that the second hinge element is arranged diagonally offset with respect to the baseplate 2. As on the first hinge element 3, on the lower edge of the hinge element 3 there are laterally protruding pins 34, which engage into the blind holes 119 of the hook body 1.

Figure 12C:
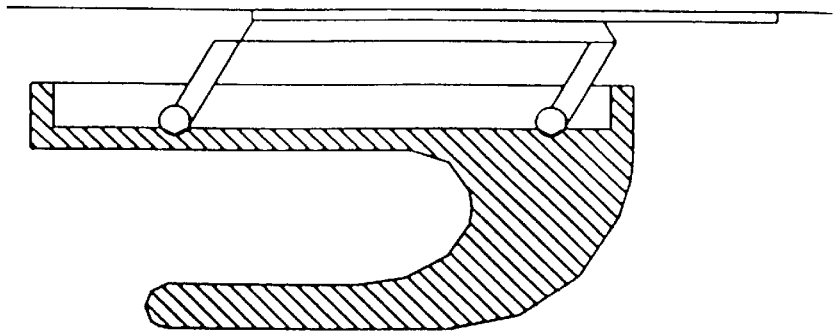
FIGS. 12*a* to 12*c* show the operation of releasing the holding device with the baseplate from FIG. 10, which has been adhesively attached on an underlying surface by means of an adhesive strip.
Figure 12B:
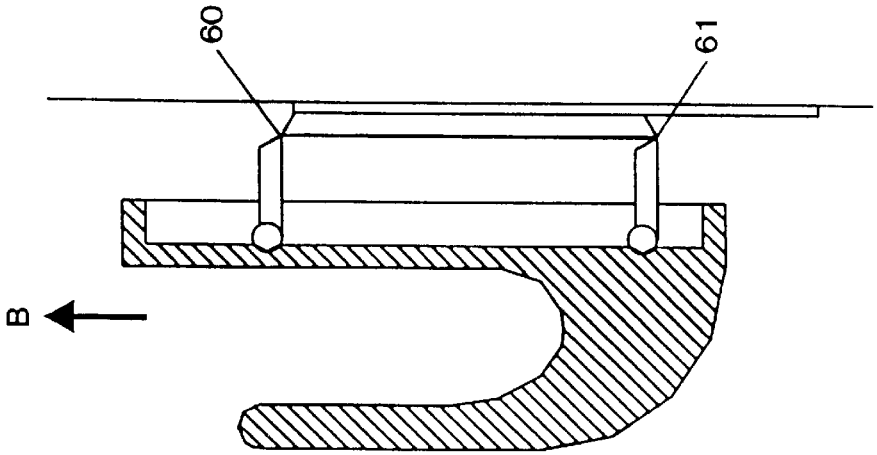
Figure 12A:
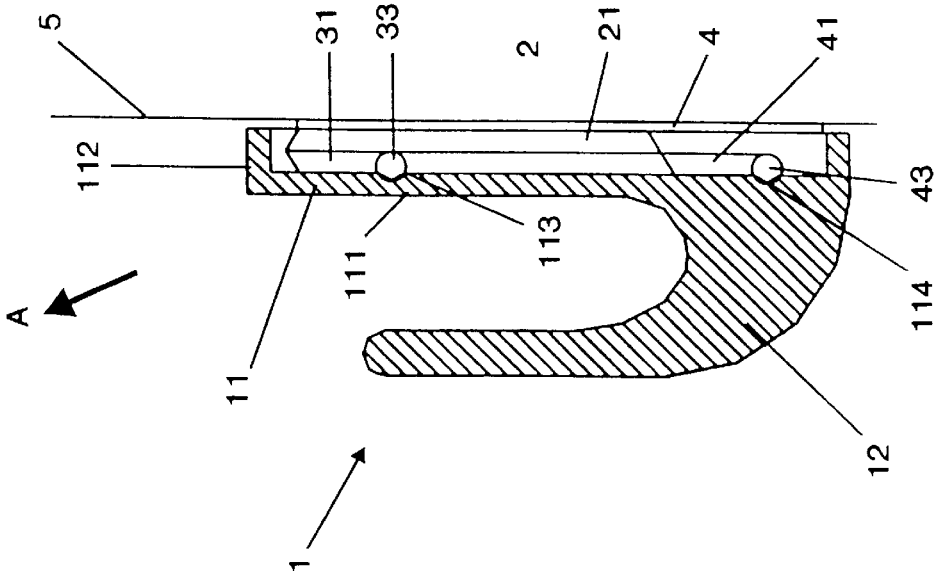

FIGS. 12*a* to 12*c* disclose the functional principle of this holding device and the releasing operation, the said device comprising hook body 1, first and second hinge elements 3, baseplate 2, which are adhesively attached on an underlying surface 5, for example a tile, by means of the adhesive strip 4. In FIG. 12*a*, the holding device is in the permanently bonded state. For this purpose, the baseplate 2 is fixed by the adhesive strip 4. The adhesive strip 4, together with grip tab, the baseplate 2 and the two hinge elements 3 are completely covered by the hook body 1.

For release, the hook body 1 is lifted off the baseplate 2 according to arrow A. Subsequently, the hook body 1 is moved upwards according to arrow B, in other words parallel to the bonding plane. By virtue of the design with two identically shaped hinge elements 3, the hook body 1 performs a movement parallel to the underlying surface 5. Once the hook body 1 has been moved sufficiently upwards, the grip tab of the adhesive strip 4 is freely accessible. By pulling in the direction of the bonding plane, the adhesive strip 4 can be released from the underlying surface 5, because the pulling forces lead to a reduction in the adhesive forces. At the same time, however, the adhesive strip 4 is also released from the baseplate 2, so that the holding device is likewise removed from the underlying surface and can be adhesively attached again.

What is claimed is:

1. Holding device, comprising a one-part hook body, at least one one-part hinge element and a one-part baseplate, the baseplate for the bond with an adhesive strip which releases on pulling being designed such that a grip tab of the adhesive strip protrudes beyond the baseplate, the hinge element being designed such that the grip tab located on the adhesive strip is covered and the hook body being designed such that in a basic position it covers over the baseplate and the hinge element, which are both arranged in one plane, in which device a) the baseplate and the hinge element are connected to each other by means of a hinge, b) the hinge element and the hook body are connected to each other by means of a hinge, and in which device, on the side adjacent to the hinge element, the hook body can be raised upwards out of the basic position, in which the hook body covers over the baseplate and the hinge element of the adhesive strip, and is displaced by a movement parallel to the baseplate, so that access to the grip tab becomes possible.

2. Holding device according to claim 1, wherein the hinges are live hinges.

3. Holding device according to claim 1, wherein on the upper edge of the baseplate and on the hook body there is articulated an upper hinge element and on the lower edge of the baseplate and on the hook body there is articulated a lower hinge element, the said hinge elements having the same dimensions.

4. Holding device according to claim 1, wherein the hook body, the baseplate, the hinge elements or any combination thereof are produced from metal or plastic.

5. Holding device according to claim 4, wherein said hook body, baseplate, hinge elements or any combination thereof are produced from plastic, and said plastic is selected from the group consisting of polyethyleneterephthalate, polystyrene or acrylonitrile-butadiene-styrene.

6. Holding device according to claim 1, wherein the hook body has a border which laterally encloses and visually conceals the baseplate, the adhesive strip and the grip tab of the adhesive strip.

* * * * *